US007984872B2

(12) United States Patent
Kuehneman et al.

(10) Patent No.: US 7,984,872 B2
(45) Date of Patent: Jul. 26, 2011

(54) AUTOMATED SHEET PRODUCT DISPENSER

(75) Inventors: Bret A. Kuehneman, Neenah, WI (US); Joseph A. Racz, Waukesha, WI (US); Mark R. Grobarchik, Brookfield, WI (US); Jeffrey A. Wierschke, Sheboygan Falls, WI (US); Antonio M. Cittadino, Appleton, WI (US); Christopher M. Reinsel, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 447 days.

(21) Appl. No.: 11/866,510

(22) Filed: Oct. 3, 2007

(65) Prior Publication Data

US 2008/0128446 A1 Jun. 5, 2008

Related U.S. Application Data

(60) Provisional application No. 60/849,209, filed on Oct. 3, 2006, provisional application No. 60/849,194, filed on Oct. 3, 2006.

(51) Int. Cl.
*B65H 63/00* (2006.01)

(52) U.S. Cl. ..... 242/563.2; 242/390.9; 242/564.1

(58) Field of Classification Search ..... 242/563, 242/563.2, 564, 564.1, 564.4, 390, 390.1, 242/390.2, 390.8, 390.9; 312/34.8, 34.22
See application file for complete search history.

(56) References Cited

U.S. PATENT DOCUMENTS

| | | | | |
|---|---|---|---|---|
| 2,121,346 | A | | 6/1938 | Harvey |
| 2,943,777 | A | | 7/1960 | Dvoracek |
| 2,993,658 | A | | 7/1961 | Sweeney |
| 4,165,138 | A | | 8/1979 | Hedge et al. |
| 4,552,315 | A | | 11/1985 | Granger |
| 4,765,555 | A | * | 8/1988 | Gambino ..... 242/564.4 |
| 4,844,361 | A | | 7/1989 | Granger |
| 4,846,412 | A | | 7/1989 | Morand |
| 4,944,466 | A | | 7/1990 | Jespersen |
| D342,635 | S | | 12/1993 | Carter et al. |
| 5,558,302 | A | | 9/1996 | Jesperson |
| 5,604,992 | A | | 2/1997 | Robinson |
| 5,628,474 | A | | 5/1997 | Krueger et al. |
| D386,025 | S | | 11/1997 | Mervar et al. |
| 5,772,291 | A | | 6/1998 | Byrd et al. |
| 5,979,821 | A | | 11/1999 | LaCount et al. |
| 5,979,822 | A | | 11/1999 | Morand et al. |
| 6,032,898 | A | | 3/2000 | LaCount et al. |
| 6,069,354 | A | | 5/2000 | Alfano et al. |
| 6,105,898 | A | | 8/2000 | Byrd et al. |

(Continued)

FOREIGN PATENT DOCUMENTS

EP 1230886 A1 8/2002

(Continued)

OTHER PUBLICATIONS

International Preliminary Report on Patentability of PCT/US2007/080311, dated Apr. 16, 2009.

(Continued)

*Primary Examiner* — William A Rivera

(57) ABSTRACT

A sheet product dispenser includes a sheet product feed mechanism coupled to a DC stepper motor, the mechanism moving a sheet product out of the dispenser during a dispense cycle; and a control unit controlling the DC stepper motor to move the sheet product with a gradually increasing acceleration during a portion of the dispense cycle.

8 Claims, 14 Drawing Sheets

U.S. PATENT DOCUMENTS

| | | | | |
|---|---|---|---|---|
| 6,138,939 | A | 10/2000 | Phelps et al. | |
| 6,152,397 | A | 11/2000 | Purcell | |
| D441,231 | S | 5/2001 | Purcell et al. | |
| 6,237,871 | B1 | 5/2001 | Morand et al. | |
| 6,250,530 | B1 | 6/2001 | LaCount et al. | |
| 6,293,486 | B1 | 9/2001 | Byrd et al. | |
| 6,328,252 | B1 | 12/2001 | Neveu et al. | |
| 6,354,533 | B1 | 3/2002 | Jespersen | |
| 6,412,679 | B2 * | 7/2002 | Formon et al. | 242/564.4 |
| 6,474,591 | B1 | 11/2002 | Granger | |
| 6,592,067 | B2 | 7/2003 | Denen et al. | |
| 6,607,160 | B2 | 8/2003 | Lewis et al. | |
| 6,616,088 | B2 | 9/2003 | Lintelmann et al. | |
| 6,685,074 | B2 | 2/2004 | Gracyalny et al. | |
| 6,695,246 | B1 | 2/2004 | Elliott et al. | |
| 6,710,606 | B2 | 3/2004 | Morris | |
| 6,736,348 | B1 * | 5/2004 | Formon et al. | 242/560.1 |
| 6,742,689 | B2 | 6/2004 | Formon et al. | |
| 6,752,349 | B2 | 6/2004 | Moody et al. | |
| 6,793,170 | B2 | 9/2004 | Denen et al. | |
| 6,826,985 | B2 | 12/2004 | Broehl | |
| 6,830,210 | B2 | 12/2004 | Formon et al. | |
| 6,854,684 | B2 | 2/2005 | Byrd et al. | |
| 6,871,815 | B2 | 3/2005 | Moody et al. | |
| 6,895,848 | B1 | 5/2005 | Svensson | |
| 6,903,654 | B2 | 6/2005 | Hansen et al. | |
| 6,977,588 | B2 | 12/2005 | Schotz et al. | |
| 6,994,408 | B1 | 2/2006 | Bunnell | |
| 7,017,856 | B2 | 3/2006 | Moody et al. | |
| 7,040,566 | B1 | 5/2006 | Rodrian et al. | |
| 7,044,421 | B1 * | 5/2006 | Omdoll et al. | 242/564.4 |
| D525,063 | S | 7/2006 | Woods et al. | |
| 7,101,441 | B2 | 9/2006 | Kennard | |
| 7,234,381 | B2 | 6/2007 | Granger | |
| D547,581 | S | 7/2007 | Cittadino et al. | |
| D551,474 | S | 9/2007 | Cittadino et al. | |
| D551,475 | S | 9/2007 | Cittadino et al. | |
| 7,296,765 | B2 * | 11/2007 | Rodrian | 242/563.2 |
| 7,370,824 | B1 * | 5/2008 | Osborne | 242/563 |
| D572,058 | S | 7/2008 | Cittadino et al. | |
| 7,398,944 | B2 | 7/2008 | Lewis et al. | |
| 7,438,257 | B2 * | 10/2008 | Kennard | 242/598.5 |
| 2002/0109035 | A1 | 8/2002 | Denen et al. | |
| 2003/0167893 | A1 | 9/2003 | Morris et al. | |
| 2003/0168489 | A1 | 9/2003 | Formon et al. | |
| 2003/0168550 | A1 | 9/2003 | Formon et al. | |
| 2003/0197086 | A1 | 10/2003 | Denen et al. | |
| 2004/0035976 | A1 | 2/2004 | Byrd et al. | |
| 2004/0041057 | A1 | 3/2004 | Byrd et al. | |
| 2004/0135027 | A1 | 7/2004 | Elliott et al. | |
| 2004/0178297 | A1 | 9/2004 | Moody et al. | |
| 2005/0077419 | A1 | 4/2005 | Thomas et al. | |
| 2005/0150992 | A1 | 7/2005 | Morris et al. | |
| 2006/0054733 | A1 | 3/2006 | Moody et al. | |
| 2006/0169827 | A1 * | 8/2006 | Lewis et al. | 242/563 |
| 2006/0175341 | A1 * | 8/2006 | Rodrian | 221/13 |
| 2006/0202080 | A1 * | 9/2006 | Kennard | 242/598.3 |
| 2007/0080255 | A1 | 4/2007 | Witt et al. | |
| 2007/0176041 | A1 | 8/2007 | Friesen et al. | |
| 2008/0018302 | A1 * | 1/2008 | Reinsel et al. | 242/564.1 |
| 2008/0078777 | A1 | 4/2008 | Cittadino et al. | |

FOREIGN PATENT DOCUMENTS

| | | | |
|---|---|---|---|
| FR | 2761252 | A1 | 10/1998 |
| GB | 2063123 | A | 6/1981 |
| JP | 4-265699 | * | 9/1992 |

OTHER PUBLICATIONS

International Search Report and Written Opinion of the International Searching Authority that issued Jun. 4, 2008 in connection with PCT/US2007/080311.

Information on Product Code: 09619, Kimberly Clark Professional wbsite, http://www.kcprofessional.com/us/product-details?prd_id=09619, viewed Dec. 17, 2007.

PCT Search Report and Written Opinion of the International Searching Authority for PCT/US2007/080316 date mailed Mar. 3, 2008.

Office Action for U.S. Appl. No. 11/866,515 dated Sep. 30, 2009.

Final Office Action for U.S. Appl. No. 11/866,515 dated Apr. 1, 2010.

* cited by examiner

AUTOMATED SHEET PRODUCT DISPENSER

CROSS-REFERENCE TO RELATED APPLICATIONS

This application claims the benefit of the filing date of U.S. Provisional Patent Application No. 60/849,209, filed Oct. 3, 2006, an U.S. Provisional Patent Application No. 60/849,194, filed Oct. 3, 2006, which are herein incorporated by reference in their entirety.

BACKGROUND

The present disclosure generally relates to sheet product dispensers and, more particularly, to sheet product dispensers having controlled dispensing mechanisms.

Electronic paper product dispensers are well known in the art, including dispensers that automatically dispense a metered length of paper material upon sensing the presence of a user. This type of dispenser has become known in the art as a "hands-free" dispenser in that it is not necessary for the user to manually actuate or otherwise handle the dispenser to initiate a dispense cycle. The control systems and mechanical aspects of conventional hands-free dispensers are wide and varied. Electric drive motors are often used to power dispensing mechanisms. Known control systems provide abrupt activation and deactivation of these drive motors during a dispense cycle. Such abrupt changes in motor speed results in impulses which are transferred to system components and the paper product during the dispense cycle. Paper jamming and excessive parts wear may result.

In some situations, paper product remains engaged with the tear bar after the dispensed sheet has been removed by a user. If left in place, this engagement by the sheet and the tear bar often results in jamming during a subsequent dispense cycle.

Accordingly, a continual need exists for improved automated sheet product dispensers.

BRIEF SUMMARY

Disclosed herein are automated sheet product dispensers.

In one embodiment, a sheet product dispenser comprises a sheet product feed mechanism coupled to a DC stepper motor, the mechanism moving a sheet product out of the dispenser during a dispense cycle; and a control unit controlling the DC stepper motor to move the sheet product with a gradually increasing acceleration during a portion of the dispense cycle.

In one embodiment, a roller assembly for a sheet product dispenser comprises a roller frame; and a plurality of flexible rubber portions spaced along a length of the roller frame, the rubber portions being overmolded onto the roller frame.

In one embodiment, a sheet product dispenser comprises a back cover; and a pair of flexible support arms having hub ends adapted to couple to a sheet product roll support shaft, with one of the support arms engaging a base extending away from a rear wall of the back cover and the other support arm being connected to the rear wall, wherein the base limits the deflection capability of one of the support arms, wherein insertion of the sheet product roll support shaft into hub ends causes the support arm connected to the rear wall to deflect to a substantially greater degree than the other support arm.

In one embodiment, a sheet product dispenser comprises a roller carried within a chassis of a dispensing mechanism, the roller being supported at its ends by a pair of shaft plugs, the shaft plug including an aperture for receiving a portion of a roller shaft and an aperture sized to receive a spring, the chassis defining a pair of plug retainers for holding the plugs and roller, the springs tending to bias the roller away from the spring retainers.

In one embodiment, a sheet product dispenser comprises a cover; a pair of arms supporting a roll of sheet product within the cover, the roll of sheet product rotating upon activation of the dispenser during a dispense cycle; and a baffle adapted to deflect upon contact with the roll of sheet product and remain engaged against the roll of sheet product during at least a significant portion of a roll life.

The above described and other features are exemplified by the following Figures and detailed description.

BRIEF DESCRIPTION OF THE DRAWINGS

Referring to the exemplary drawings wherein like elements are numbered alike in the several Figures.

DETAILED DESCRIPTION

Disclosed herein are automated sheet product dispensers. The term "sheet products" is inclusive of natural and/or synthetic cloth or paper sheets. Further, sheet products can include both woven and non-woven articles. Examples of sheet products include, but are not limited to, wipers, napkins, tissues, and towels. For ease in discussion, however, reference is hereinafter made to embodiments particularly suited for paper products.

Figure 1:
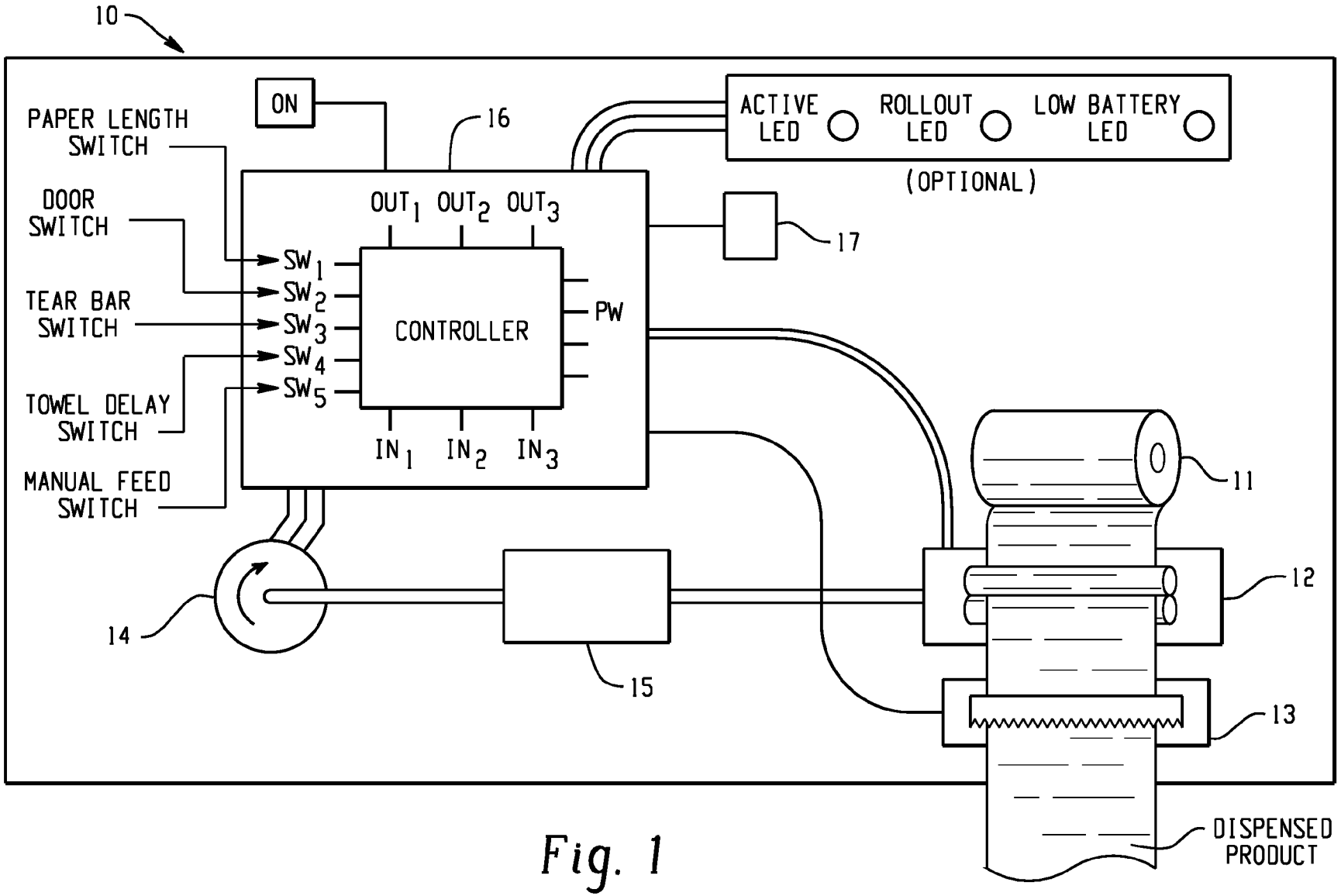
FIG. 1 is a schematic illustration of a dispenser.

Referring now to FIG. 1, a schematic illustration of a sheet product dispenser, generally designated 10, is provided to illustrate various mechanical components employed in exemplary automatic sheet product dispensers with the understanding that the mechanical components disclosed herein are not limiting to the invention. Exemplary mechanical aspects of dispensers include, but are not limited to, those mechanical aspects disclosed in U.S. Pat. Nos. 6,592,067; 6,793,170; 6,838,887; 6,871,815; 7,017,856; 7,102,366; 7,161,359; 7,182,288; 7,182,289; and U.S. Patent Publication No. 2007/0194166, each patent and patent application being incorporated herein by reference in its entirety.

Figure 2:
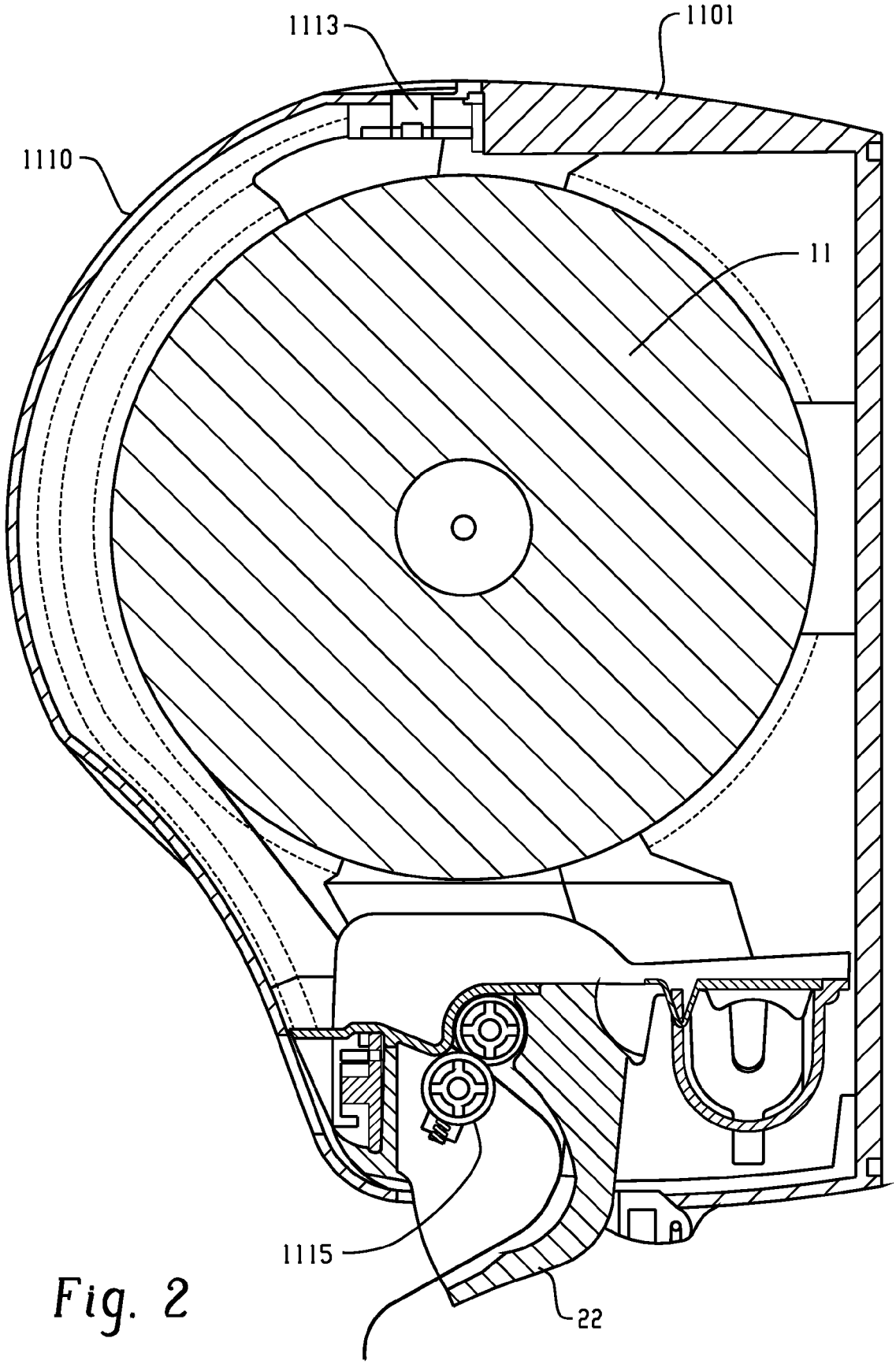
FIG. 2 is an illustration of a portion of a dispenser.
Figure 3:
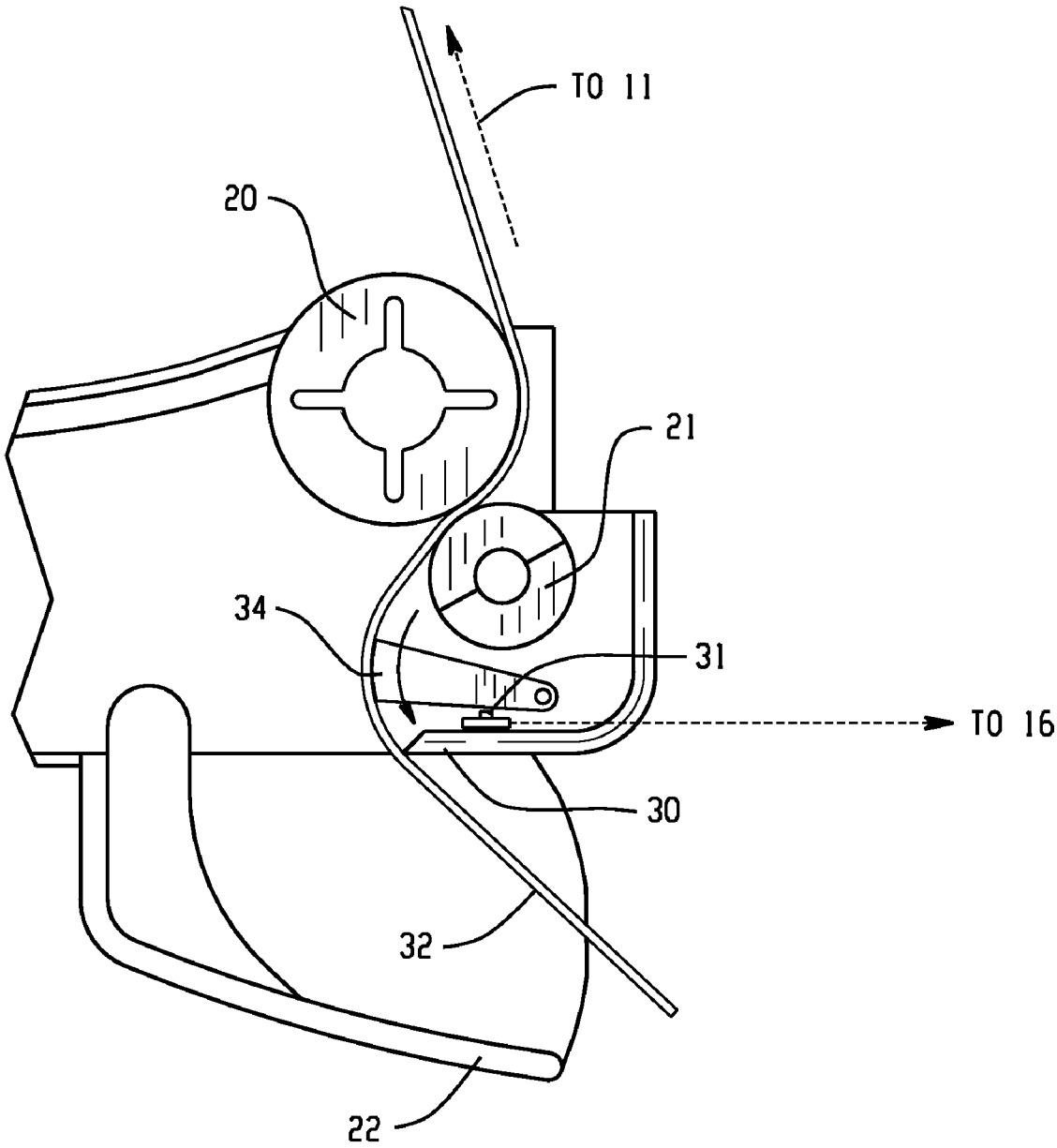
FIG. 3 is an illustration of a portion of the dispenser.

In one embodiment, referring to FIGS. 1-3, the sheet product dispenser 10 includes a sheet product supply, such as a roll 11 of sheet product (e.g., tissue or paper towel) and a feed mechanism for moving sheet product within and out of dispenser 10. Feed mechanism may include a feed roller 20, pinch roller 21 and sheet product chute 22. Dispenser 10 may be adapted for hands-free operation for dispensing one or more rolls 11 of sheet product. Dispenser 10 may further include a tear bar assembly 13 allowing a sheet of the sheet product to be separated from sheet product roll 11.

As shown in FIG. 3, tear bar assembly 13 includes a tear bar 30 and switch 31 in communication with a microprocessor (also referred to interchangeably as controller) as described in more detail hereinafter. In operation, to remove a portion 32 of sheet product roll 11, a user pulls portion 32 downward against stationary tear bar 30. As sheet portion 32 is pulled against tear bar 30, contact is made between the sheet and movable arm 34 causing arm 34 to rotate into contact with switch 31. Upon engagement with arm 34, switch 31 signals controller 16 that a tear operation has taken place. In cases where perforated paper is dispensed, the tear bar 30 may be omitted.

Dispenser 10 includes a DC (direct current) stepper motor 14 and transmission 15. Transmission 15 may include gears, pulleys, belts, and the like to transfer rotational forces from stepper motor 14 to feed mechanism 12. In one embodiment, transmission 15 includes a motor shaft, which directly couples stepper motor 14 to feed roller 20. Stepper motor 14 is powered by power supply (not shown), such as a battery pack or external AC (e.g., with an appropriate transformer and adapter) or DC power supply. Moreover, it is to be understood that the dispenser 10 may be configured to be switched between battery power and AC power.

DC stepper motors are typically brushless. Failure-prone components of brushes and commutator are eliminated in stepper motors. Stepper motors move in quantified increments or steps and as long as the motor runs within its specification, the position of the shaft is known at all times without the need for a feedback mechanism. A controller, such as proportional integral differential (PID) microcontroller, can be used for implementation of stepper motor control techniques. Other microcontrollers could also be used.

In one embodiment, controller 16 includes a microcontroller 46. One suitable microcontroller is Microchip, Inc.'s CMOS FLASH-based 8-bit microcontroller, model PIC16F72, which features 5 channels of 8-bit analog-to-digital (A/D) converter with 2 additional timers, capture/compare/PWM (pulse-width-modulation) function and a synchronous serial port.

Inputs to controller 16 can include a battery voltage signal, a tear bar activation signal, a cover switch signal, a paper length switch signal, a towel delay switch, a manual advance switch signal and an on switch signal. Outputs of control unit 16 can include a motor control signals and LED signals. Motor control signals are used to control stepper motor 14 and hence the speed of paper moved by feed mechanism 12 as described herein.

Stepper motor 14 can be a bipolar stepper motor. Stepper motor 14 can run more efficiently than a regular DC motor with gear reduction. Stepper motor 14 allows for a smaller battery package using three D-Cell batteries, rather than four or more D-cell batteries of prior art dispensers, with comparable battery life per roll.

Figure 4:
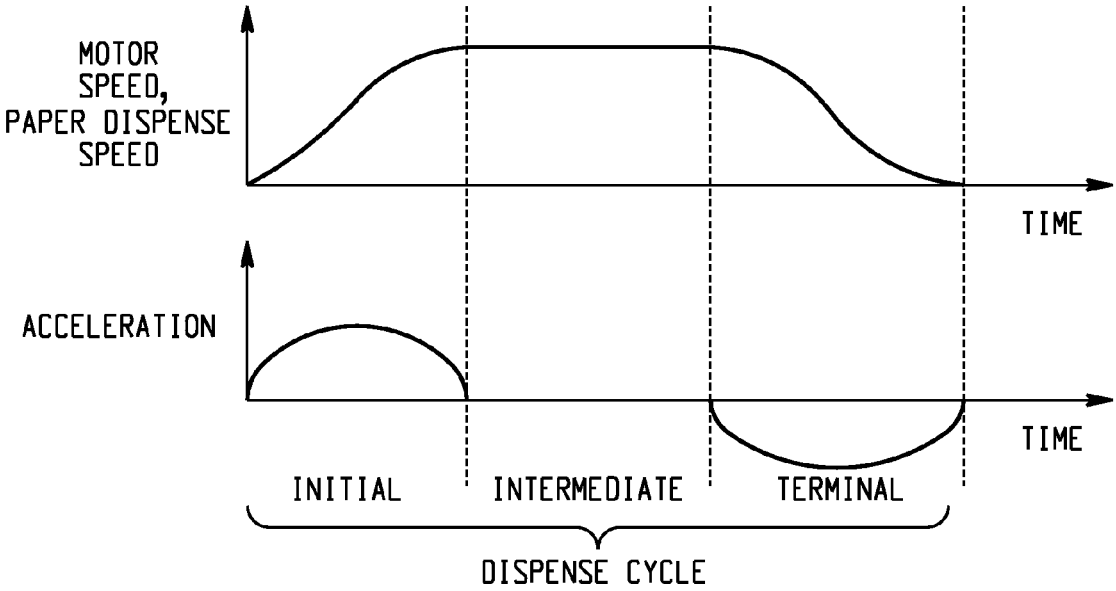
FIG. 4 is an illustration of speed and acceleration curves for motor speed or paper product dispense speed for a dispenser.

FIG. 4, with periodic reference to FIG. 1, illustrates relationships between sheet product dispense speed, acceleration and time over a dispense cycle of the dispenser 10. As the speed of stepper motor 14 is proportional to the sheet product dispense speed, FIG. 4 also illustrates velocity and acceleration curves exhibited by stepper motor 14 during the dispense cycle. A dispense cycle is initiated by ON switch activation (i.e., a user dispense request). The ON switch signal may be provided, for example, by a push button switch, an I/R (infrared) proximity sensor, a capacitance-based proximity sensor or another electronic proximity sensor. In response to ON switch activation, a length of sheet product is dispensed during a dispense cycle.

FIG. 4 shows possible curves for both the speed and acceleration of stepper motor 14 speed during initial, intermediate and terminal portions of the dispense cycle. During the initial portion of the dispense cycle, stepper motor 14 speed increases to a maximum motor speed. During an intermediate portion of the dispense cycle, stepper motor 14 speed is generally constant. The length of the intermediate portion may be fixed or variable as determined by controller 16. During a terminal portion of the dispense cycle, stepper motor 14 speed gradually decreases to zero. In one embodiment, the dispense cycle has a length of between 5 to 10 seconds for a non-continuous mode of operation.

By controlling the acceleration and deceleration of the sheet product as it is dispensed, product damage and jamming can be minimized. This is especially significant with light weight tissue paper products. Controlled acceleration of the sheet product may also decrease the impulse loads applied through the transmission and dispensing mechanism.

While FIG. 4 illustrates particular curves of velocity and acceleration during a dispense cycle, curves of velocity and acceleration during a dispense cycle may vary. For example, motor velocity may increase linearly during the initial portion of the dispense cycle or the length of the intermediate portion may be shortened or lengthened depending on a particular application or product and depending on the voltage measured during the cycle or preceding cycles. It is envisioned that a variety of different curves could be utilized to practice the concept of controlled velocity and/or acceleration of the product during a dispense cycle.

Figure 5:
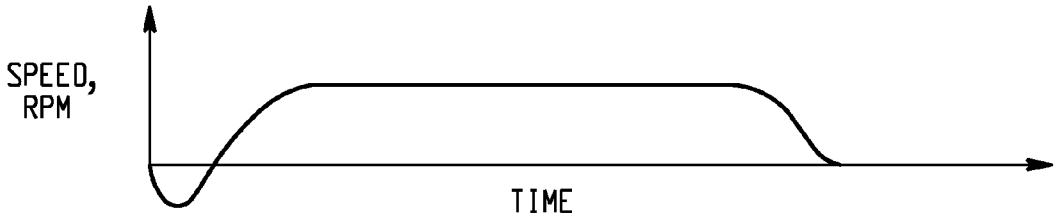
FIG. 5 is an illustration of a paper product speed curve.

FIG. 5, with periodic reference to features found in FIGS. 1-3, illustrates another paper speed curve during a dispense cycle. In this example, the paper direction is initially reversed prior to forward advancement. In some situations, this reverse paper movement disengages the paper product from contact with the tear bar in order to avoid paper jamming. A tear bar switch signal may be used to initiate a reverse paper movement. For example, if the tear bar switch 31 is activated upon a user request (via IR sensor, for example), controller 16 could initially reverse paper movement to pull the paper product away from tear bar 30. The length of reverse paper movement can be accurately controlled via controller 16.

Figure 6:
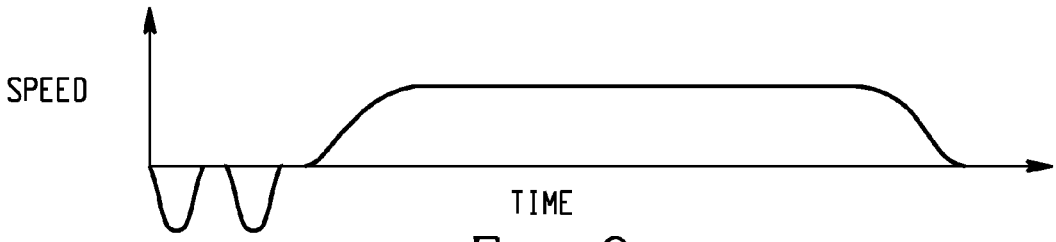
FIG. 6 is an illustration of a paper product speed curve.
Figure 7:
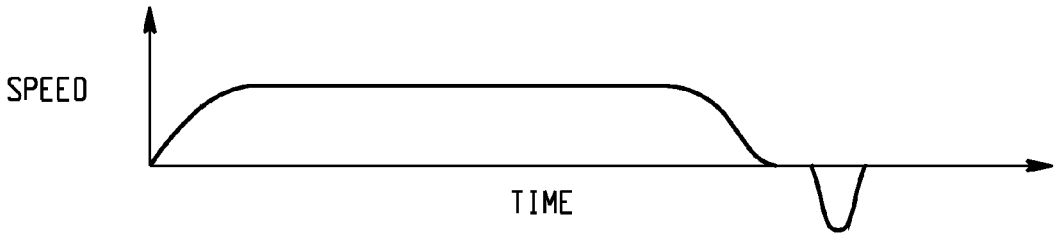
FIG. 7 is an illustration of a paper product speed curve.

FIG. 6 illustrates another paper speed curve wherein multiple reversals are made to the paper product upon activation of a dispense cycle. FIG. 7 illustrates yet another example of a paper speed curve wherein a paper reversal occurs after forward movement of the paper through dispenser 10 (FIG. 1). Such a paper reversal may be triggered by detection of a tear bar switch activation after some period of time. Alternatively, such a paper reversal may occur during each dispense cycle regardless of whether the tear bar switch remains activated or not. In yet another example, the paper cycle may include an initial paper reversal followed by forward motion and finally yet another paper reversal.

Figure 8:
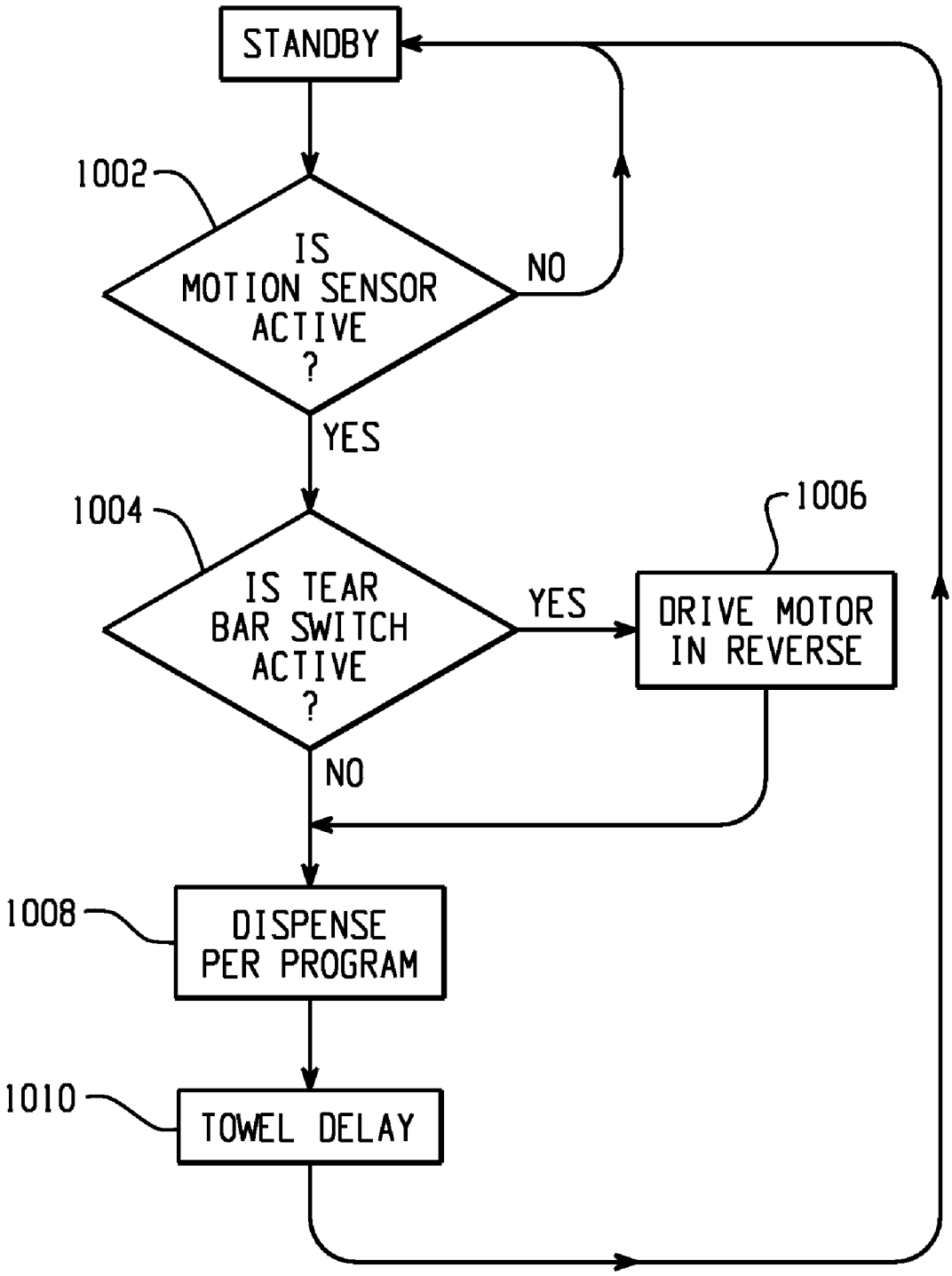
FIG. 8 is a flow diagram of a control system operation.

FIG. 8, with periodic reference to features found in FIGS. 1-3, illustrates an embodiment of a process flow chart for dispenser 10. Dispenser 10 remains in a Standby state until IR sensor detects a user request at step 1002. An inquiry of tear bar switch status is made at step 1004. If tear bar switch is activated, controller 16 drives stepper motor 14 in reverse at step 1006, for example, following a reverse curve of FIGS. 5-7. If tear bar switch is not activated or upon completion of a paper reversal at step 1006, controller 16 drives stepper motor 14 in a forward direction at step 1008, for example following forward motion curves of FIGS. 5-7. A time delay based on towel delay switch occurs at step 1010 prior to a return to the Standby state.

Figure 9:
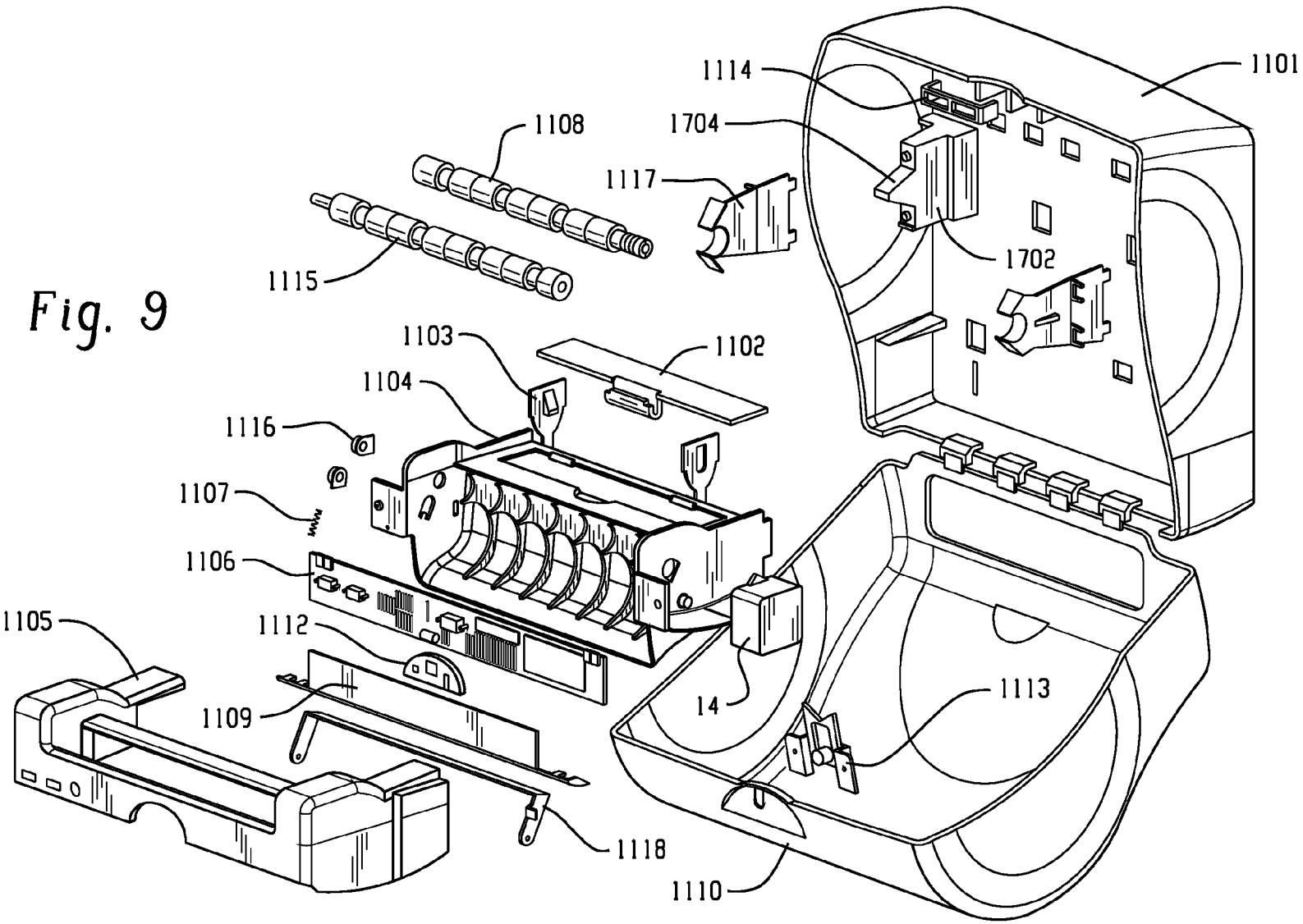
FIG. 9 is an exploded view of a dispenser.
Figure 10:
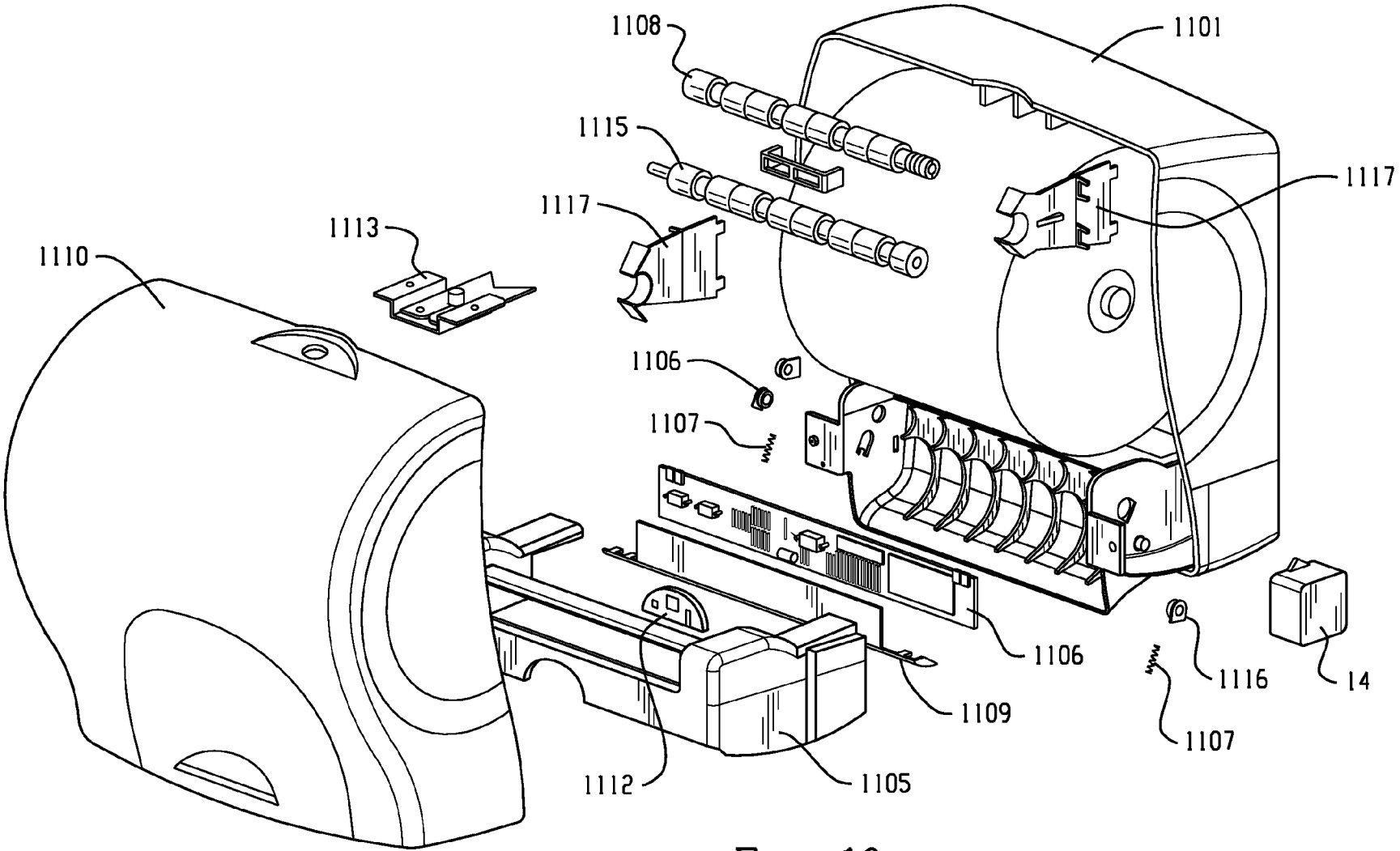
FIG. 10 is an exploded view of a dispenser.
Figure 11:
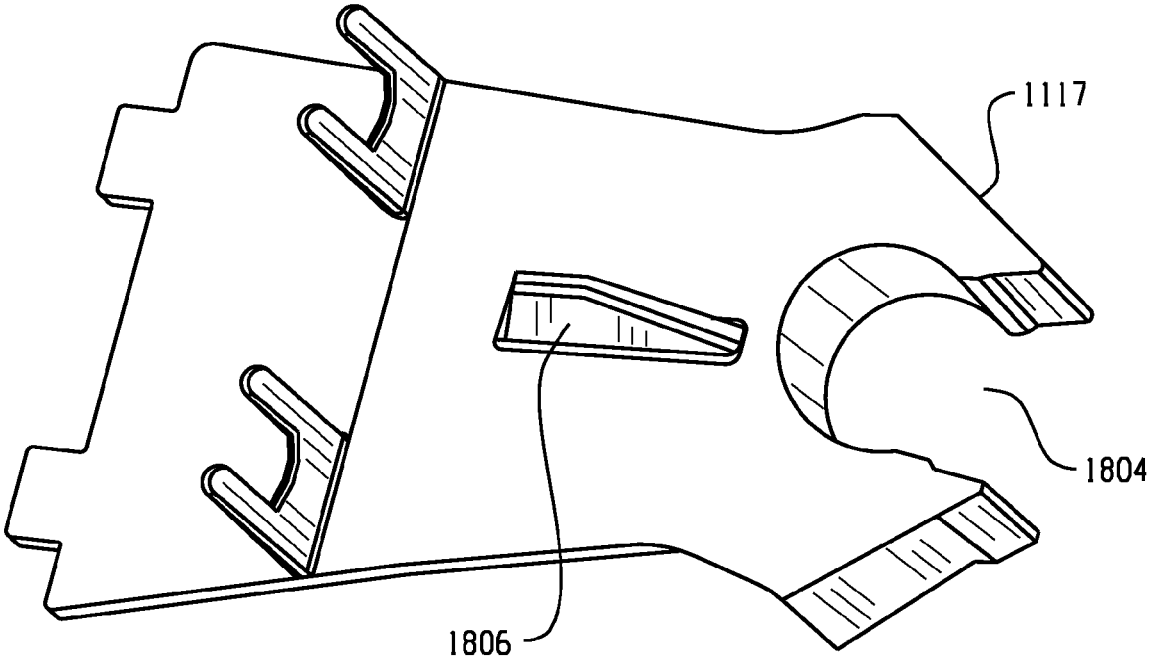
FIG. 11 is a perspective view of a support arm for a dispenser.

Referring to FIG. 9, in one embodiment, dispenser 10 includes back cover 1101, battery lid 1102, battery contact 1103, chassis 1104, chassis cover 1105, circuit board 1106, compression spring 1107, drive roller 1108, front cap 1109, front cover 1110, stepper motor 14, lens 1112, lock 1113, lock latch 1114, pinch roller 1115, shaft plug 1116, support arm 1117 and tear bar 1118. The drive roller assembly is packaged in a modular unit with tear bar 1118, stepper motor 14, battery pack, IR sensor assembly, and circuit board 1106. The modular unit can be assembled away from the remaining portions of dispenser 10. Dispenser components can then be brought together at final assembly. The modular unit can also be used as a service kit to replace only the modular unit of a defective dispenser 10 without removing dispenser 10 from the customer site.

In one embodiment, referring particularly to FIGS. 10 and 11-14, a pair of support arms 1117 are provided to support hub ends of a paper product shaft. One of the arms 1117 is secured against base 1702 while the other arm 1117 is secured against base 1703 (shown in FIG. 13). An opening 1804 at support arm 1117 end provides for a snap-fit connection between arm 1117 and the paper shaft hubs. Each arm 1117 includes a rib 1806. Rib 1806 engages extension 1704 of base 1702. Base 1703 does not have extension 1704 and arm rib 1806 does not directly engage base 1703. The deflection capability (in a direction toward outer walls of the dispenser) of arm 1117 secured against base 1702 is significantly less than the deflection capability of the other arm 1117 secured against base 1703 (rib 1806 contacting extension 1704 limits deflection of one arm). Consequently, when the paper roll is inserted into dispenser 10, arm 1117 secured against base 1703 deflects to a substantially greater degree than the other arm 1117. The deflection of support arms 1117 promotes ease of assembly and improved stability of the mounted roll holder and assists in inserting the roll of paper product 11 during replacement.

Figure 12:
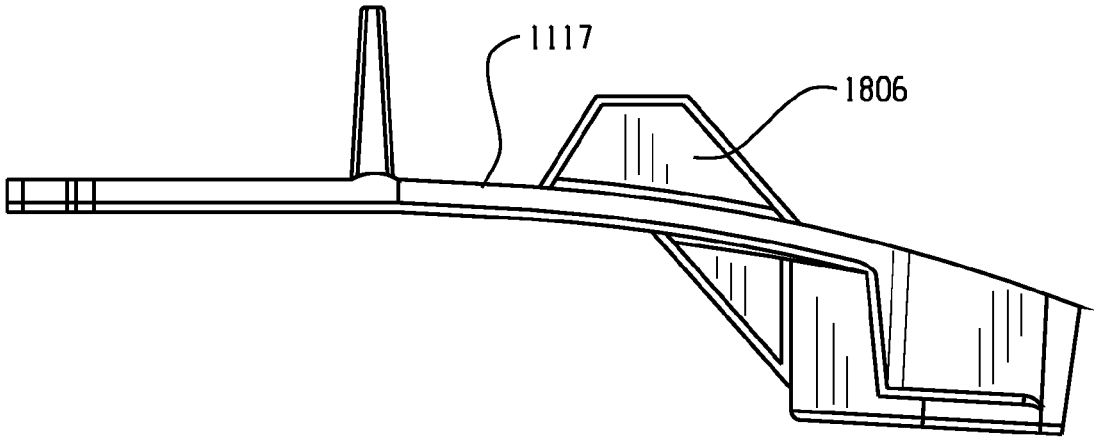
FIG. 12 is a side view of a support arm for a dispenser.
Figure 13:
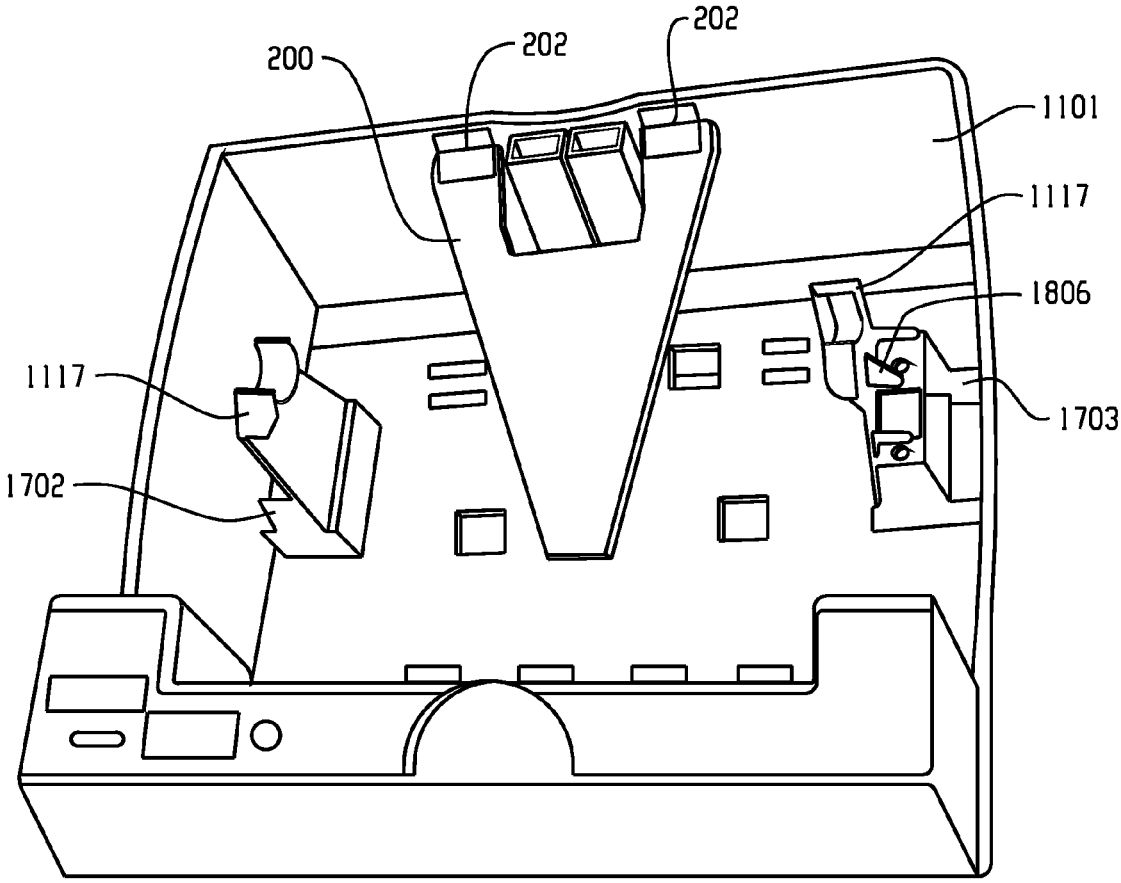
FIG. 13 is a top perspective view of a back cover for a dispenser with a baffle.
Figure 14:
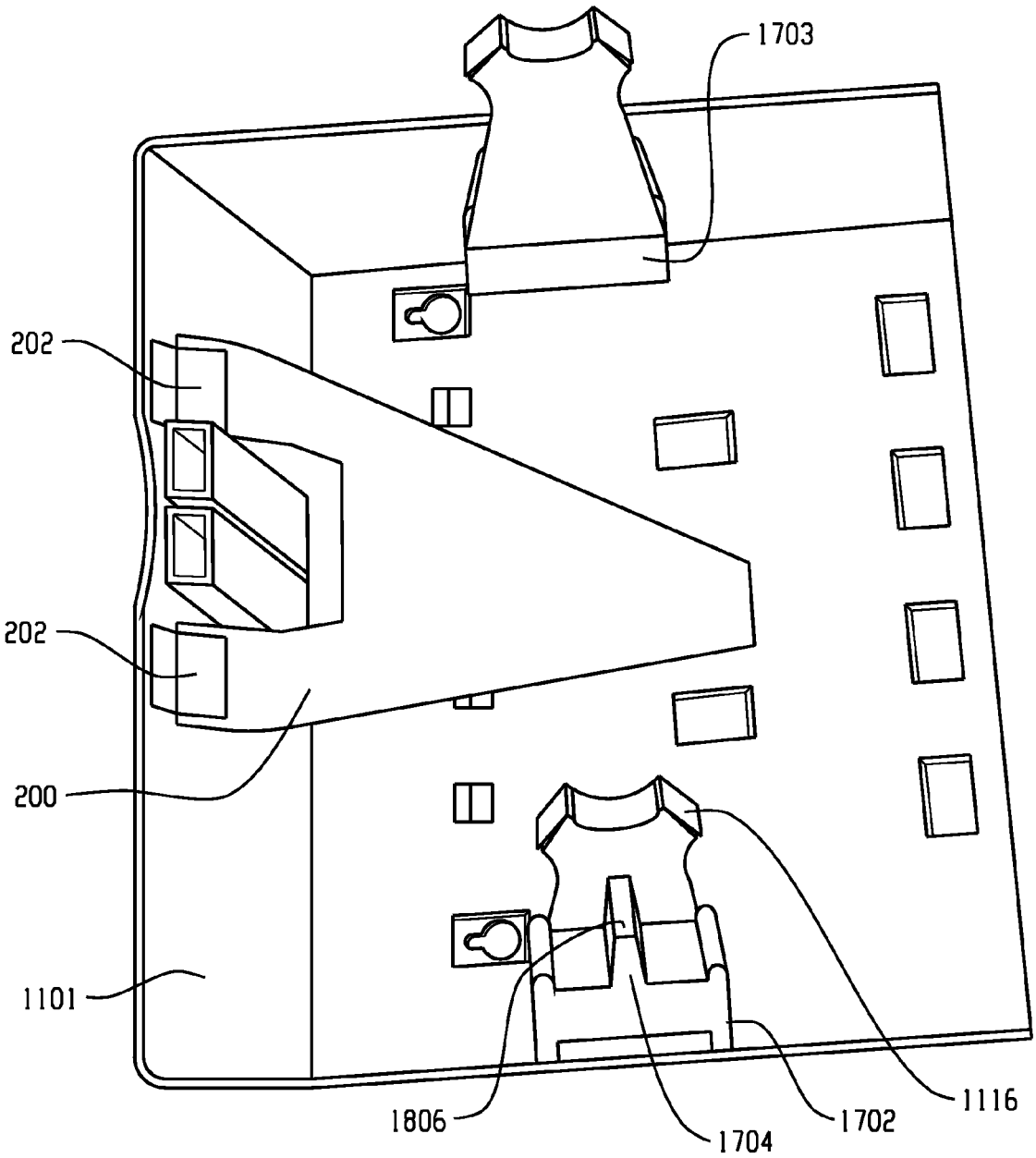
FIG. 14 is an enlarged view of a portion of a back cover for a dispenser with a baffle.

FIGS. 12 and 13 illustrate an overspin baffle 200 attached to back cover 1101. As illustrated, overspin baffle 200 is connected to cover 1101 through hinge element 202. Hinge element 202 can be a living hinge or other known structure. Hinge element may be optional. For example, one end of baffle 200 may be rigidly connected to cover 1101. Baffle 200 is preferably a resilient element adapted to deflect upon contact with the roll of paper product 11 and remain engaged with the roll throughout at least a significant portion of the roll life. Baffle 200 provides sufficient friction to limit overspin of the roll. In the illustrated example, baffle 200 is generally triangular in form and made of a flexible plastic or metal sheet. Other shapes and cross sections would be practicable. In other embodiments, baffle 200 may be coupled to other portions of back cover 1101 or front cover 1110.

Figure 15:
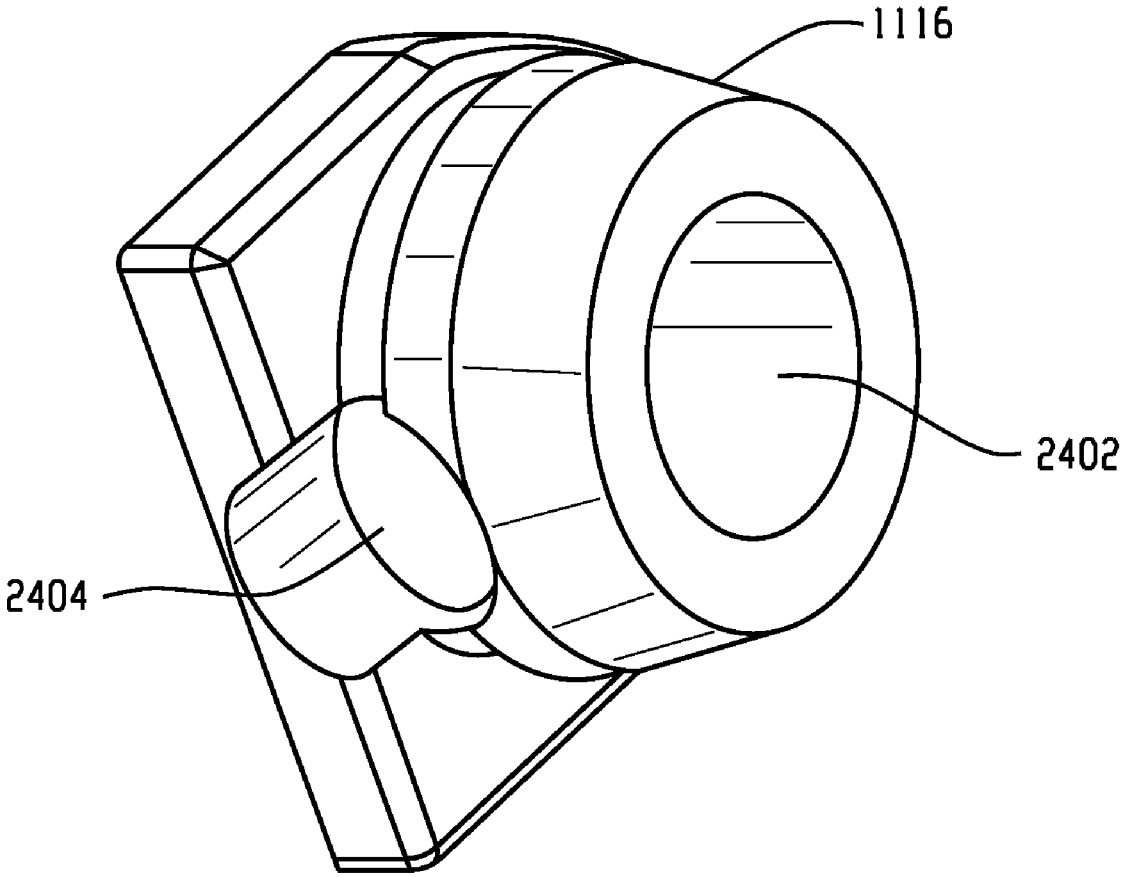
FIG. 15 is a perspective view of a shaft plug for a dispenser.
Figure 16:
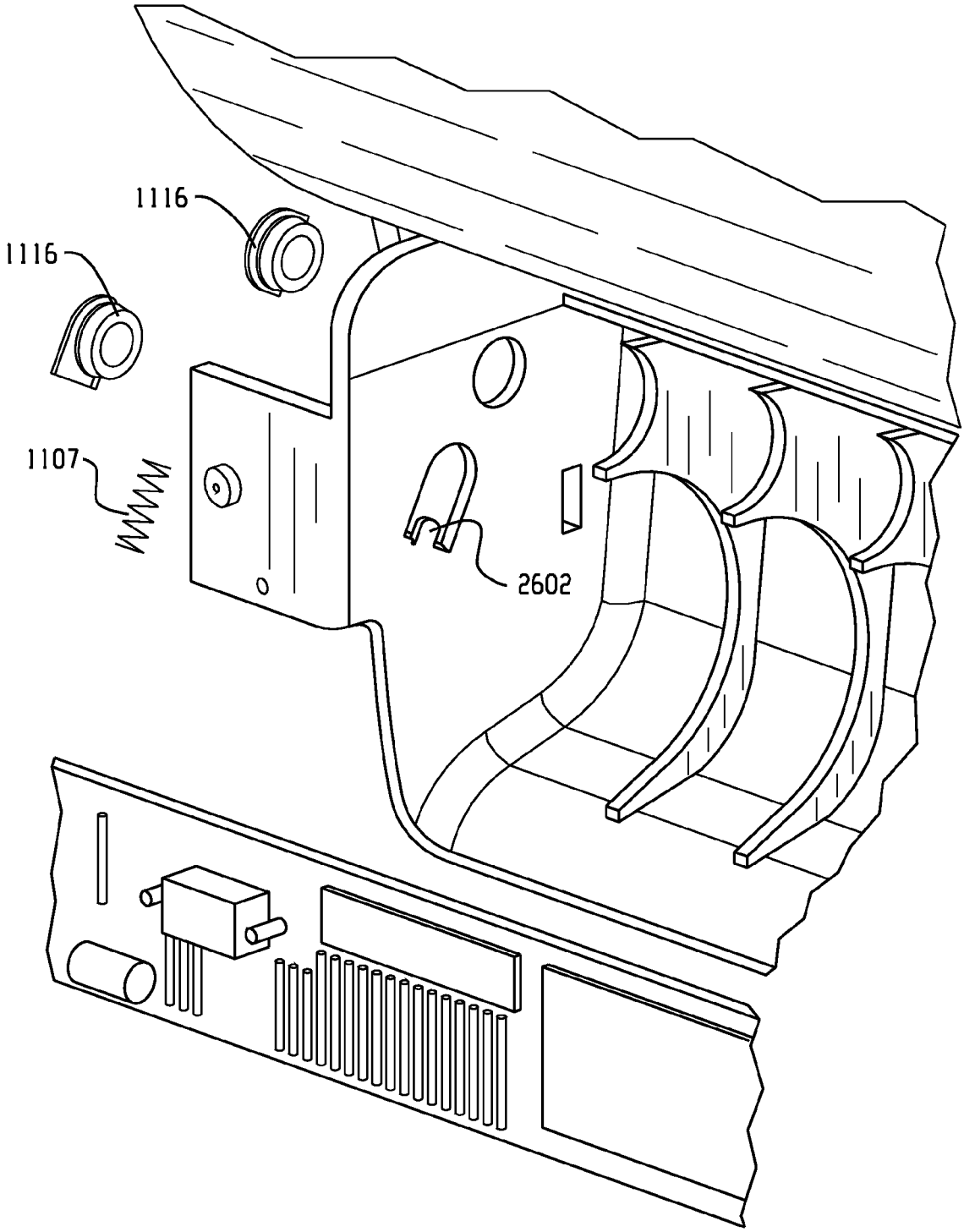
FIG. 16 is an enlarged portion of a dispenser highlighting shaft plugs, compression spring, and spring retainer.
Figure 18:
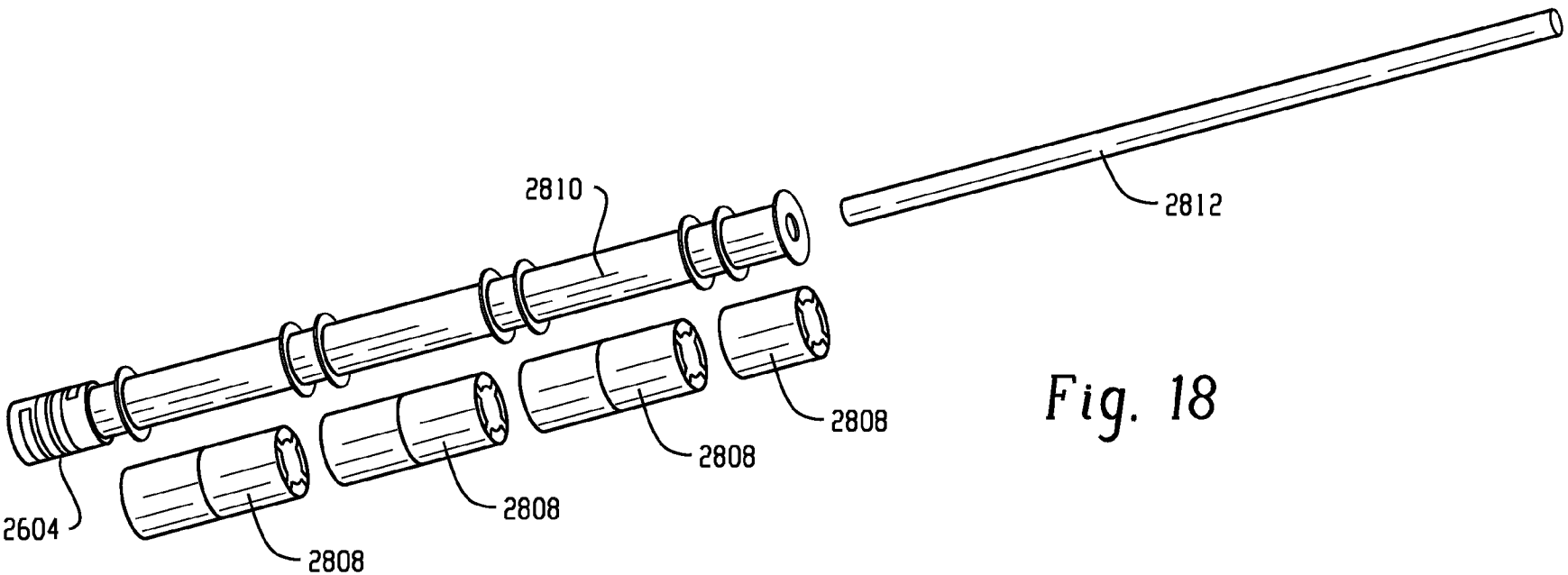
FIG. 18 is an exploded view of a drive roller for a dispenser.
Figure 19:
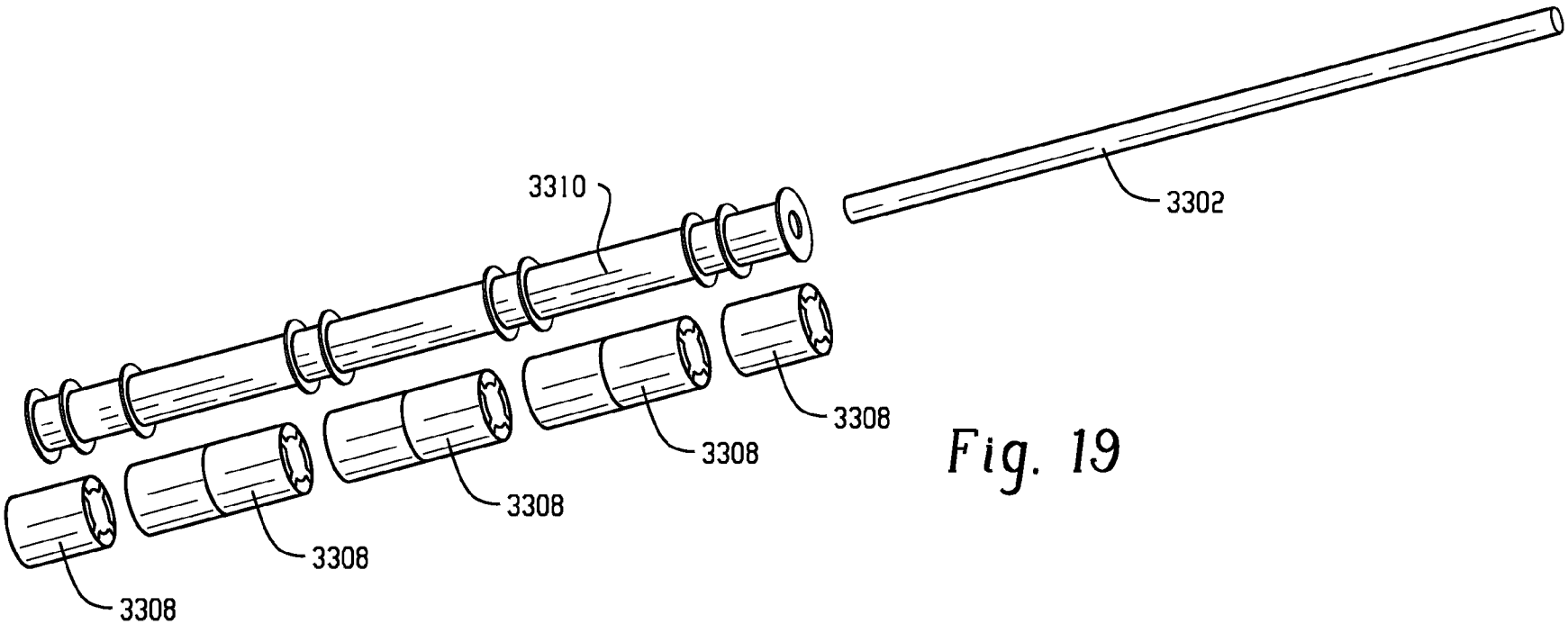
FIG. 19 is a side view of a pinch roller for a dispenser.
Figure 20:
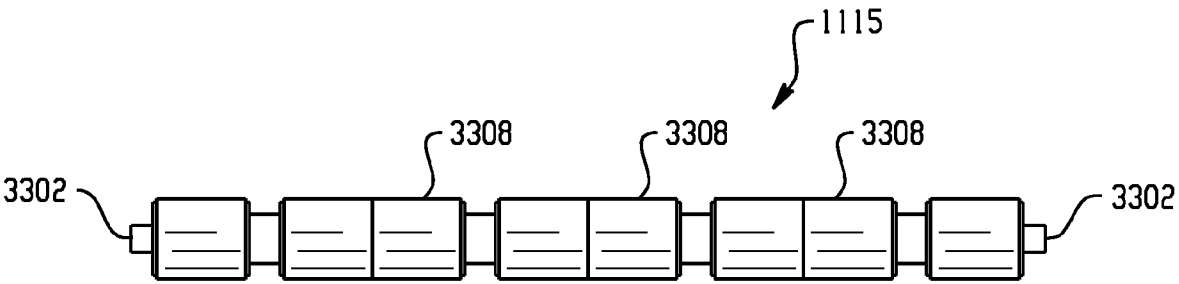
FIG. 20 is an exploded view of a pinch roller for a dispenser.

FIGS. 15-16 illustrate shaft plug 1116, spring 1107, and pinch roller 1115 in detail. Shaft plug 1116 includes an aperture 2402 sized to receive shaft 3302 (FIG. 19) of pinch roller 1115 or shaft 2812 of feed roller 1108 (FIG. 18). A bearing surface for pinch roller 1115 and feed roller 1108 is provided by aperture 2202. Plug 1116 includes an aperture 2404 sized to receive one end of spring 1107. Upon assembly, the other end of spring 1107 engages spring retainer 2602 (FIG. 16). A pair of plugs 1116 are used to connect pinch roller 1115 to chassis 1104. Each pinch roller plug 1116 is able to slide along plug flange structure 2502. Springs 1107 tend to bias plugs 1116 away from spring retainer 2602. Limited non-axial deflection of pinch roller 1115 is thus provided by plugs 1116 and flange structure 2502. Such non-axial deflection is useful, particularly during roll replacement. Plugs 1116, springs 1107 and spring retainers 2602 provide an additional benefit during assembly as compared to prior art pinch roller designs.

Figure 17:
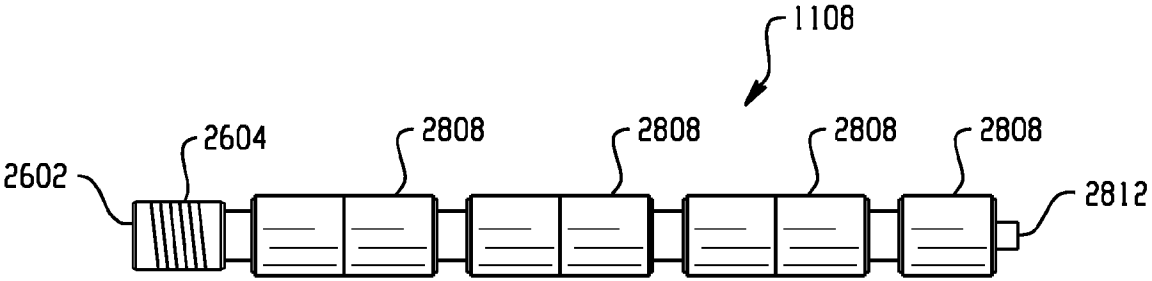
FIG. 17 is a side view of a drive roller for a dispenser.

Referring to FIGS. 16-17, drive roller 1108 is coupled to stepper motor 14 at end hub 2602. In one embodiment, a motor shaft portion is inserted into end hub 2602 of drive roller 1108. For example, a d-shaped motor shaft may be inserted into a correspondingly-shaped slot at end hub 2602. Drive roller 1108 is provided with a flexible coupling 2604 at end hub 2602. Flexible coupling 2604 for interconnecting drive roller 1108 to stepper motor 14 accommodates shaft misalignments and permits limited deflection in non-axial directions. Flexible coupling 2604, in this illustrated embodiment, is helical beam coupler. The beam coupler 2604 includes one or more sets of flexible elements, in effect curved beams. Stresses induced in the couple are spread evenly between the beams. Other benefits include single piece construction with no moving parts or elastomeric elements to wear, and backlash free operation with low wind-up. Helical beam coupling 2604 reduces motor vibration for increased paper feed stability and reduces sound generation. Beam coupling 2604, in the illustrated embodiment, is integrated with the balance of drive roller 1108. In other embodiments, a beam coupling may be a separate component.

Referring to FIG. 16, both pinch roller 1115 and drive roller 1108 may be assembled using an overmolding technique whereby a relatively rigid roller frame is molded onto a shaft and flexible roller rubber portions are then overmolded onto the roller frame to define roller surfaces. An example method of manufacturing includes inserting shaft 2812 of feed roller 1108 into a die form and molding roller frame 2810 around shaft 2812. The shaft 2812 and frame 2810 are then inserted into another die form where roller rubber portions 2808 are molded into contact with roller frame 2810. In one embodiment, frame 2810 is injection molded acetal and rubber portions 2808 are injection molded EPDM. A similar method may be used to manufacture pinch roller 1115 of FIGS. 33-34. In this manner, rollers 1115 and 1108 are more easily assembled as compared to prior art roller assemblies having multiple separate roller rubber portions and frame portions needing to be aligned along a roller shaft during assembly. Benefits of such overmolded rollers include improve paper feed quality and a reduction in component assembly cost.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A sheet product dispenser comprising:

a sheet product feed mechanism coupled to a DC stepper motor, the mechanism moving a sheet product out of the dispenser during a dispense cycle; and a control unit controlling the DC stepper motor to move the sheet product with a gradually increasing acceleration during a portion of the dispense cycle;

wherein the control unit controls the DC stepper motor to move the sheet product in a direction that is initially reversed prior to forward advancement of the sheet product.

2. The sheet product dispenser of claim 1, wherein during another portion of the dispense cycle, the feed mechanism dispenses the sheet product at a gradually decreasing acceleration.

3. The sheet product dispenser of claim 1, wherein during another portion of the dispense cycle, the feed mechanism dispenses the sheet product at a generally constant speed.

4. The sheet product dispenser of claim 1, wherein during another portion of the dispense cycle, the feed mechanism dispenses the sheet product at a generally constant speed and then gradually decreases the speed to zero.

5. The sheet product dispenser of claim 1, wherein multiple reversals of the sheet product is made upon activation of a dispense cycle.

6. The sheet product dispenser of claim 1, wherein the control unit further controls the DC stepper motor to move the sheet product in a reverse direction subsequent to forward advancement of the sheet product.

7. A sheet product dispenser comprising:

a sheet product feed mechanism coupled to a DC stepper motor, the mechanism moving a sheet product out of the dispenser during a dispense cycle; and a control unit controlling the DC stepper motor to move the sheet product with a gradually increasing acceleration during a portion of the dispense cycle;

wherein the control unit controls the DC stepper motor to move the sheet product in a reverse direction subsequent to forward advancement of the sheet product.

8. A sheet product dispenser comprising:

a sheet product feed mechanism coupled to a DC stepper motor, the mechanism moving a sheet product out of the dispenser during a dispense cycle; and a control unit controlling the DC stepper motor to move the sheet product with a gradually increasing acceleration during a portion of the dispense cycle;

wherein the control unit controls the DC stepper motor to move the sheet product in a reverse direction during each dispense cycle.

* * * * *